United States Patent [19]

Thomson et al.

[11] 4,089,295

[45] May 16, 1978

[54] SPRAY COATER DEVICE

[75] Inventors: Ronald E. Thomson, Cambridge; James F. Schmitt, Marshall, both of Wis.

[73] Assignee: Madison-Kipp Corporation, Madison, Wis.

[21] Appl. No.: 654,216

[22] Filed: Feb. 2, 1976

[51] Int. Cl.[2] ..... B05C 11/16

[52] U.S. Cl. ..... 118/316; 118/324; 118/326

[58] Field of Search ..... 118/316, 324, 326, 65

[56] References Cited

U.S. PATENT DOCUMENTS

| | | | |
|---|---|---|---|
| 3,516,388 | 6/1970 | Barnes | 118/326 X |
| 3,850,659 | 11/1974 | Barnes | 118/326 X |

*Primary Examiner*—Louis K. Rimrodt

*Attorney, Agent, or Firm*—Merriam, Marshall & Bicknell

[57] ABSTRACT

A fluid applying system in which a substantial portion of the componentry surface area of a conveyor system is sprayed with a fluid in a spray chamber and any excess or overspray is passed to an evacuating chamber and filtering station where any fluid particles are removed, thereby protecting the surrounding environment from being contaminated with fluid.

7 Claims, 3 Drawing Figures

SPRAY COATER DEVICE

BACKGROUND OF THE INVENTION

This invention relates to a spray device for coating conveyor systems and more particularly to a system for coating conveyors used in the food processing industry where it is extremely important that no contaminants come in contact with the food products or the surrounding environment.

In some applications it is of prime importance that a plurality, or all of the parts, of a conveyor system be coated. What this requires is spraying a fluid, such as oil, onto the parts of a conveyor. In those instances where the fluid is sprayed, it is imperative that the surrounding environment not be contaminated with the fluid particles. For example, in the food processing industry, food or animal carcasses often are suspended from the conveyor and transported to various work stations. In this type of conveyor application, any system must insure that there is no contamination of the food product or animal carcass. At the same time all, or a substantial portion, of the parts of the conveyor system, e.g., chains, brackets and wheels, must be coated.

Further, the fluid applying device must be compact, portable in the sense it can be moved from one station to another, and preferably it should be adapted to be used with air and electrical power sources already available in a plant or other facility. Accordingly, it is desired to have a compact fluid applying system in which the parts of a conveyor can be coated to provide a protective coating medium that will minimize conveyor wear and drag. At the same time the system must prevent contamination of the environment outside the coating device.

SUMMARY OF THE INVENTION

With the view of obviating the problems inherent in conveyor systems presently available and to provide proper protection of parts in conveyors such as those employed in the food processing industry, the invention disclosed and claimed herein relates to a system which sprays the parts of a conveyor chain as the chain passes by the fluid applying station. The device includes means for spraying or coating the conveyor with a lubricating medium. The spraying operation is confined to a chamber located in an enclosure assembly through which the conveyor chain to be coated passes. Over-spraying of the conveyor is precluded so there is no contamination of the environment outside the enclosure assembly.

The spraying operation is accomplished in a fully enclosed device in which any excess overspray of the lubricating fluid is withdrawn from the enclosure assembly, filtered to remove the contaminant or fluid particles, after which the filtered fluid is recirculated to a reservoir in the enclosure assembly.

Briefly, the invention disclosed and claimed herein relates to a spray coater device which is fixed relative to a chain conveyor to be coated. The device comprises three adjacent compartments in an enclosure assembly through which a conveyor chain passes. The center chamber or compartment, which is separated from adjacent compartments by a baffle system, serves as an oil fog chamber. Spray units are positioned to spray lubricating fluid in this compartment. The adjacent chambers are displacement or evacuation chambers in which air and any fluid particles entrained therein are evacuated from the chambers by means of an exhaust blower. An electrostatic precipitator filter station where contaminants are removed from the air is positioned between the displacement chambers and blower.

In operation, the fog chamber receives oil and air sprayed into the chamber in a fog-like state. As a conveyor chain passes through the fogging chamber, it is evenly sprayed by four spray units. Subsequently, the sprayed conveyor passes to a displacement or evacuation chamber and out the enclosure assembly. Any overspray is evacuated from the displacement chamber by means of the blower. The exhausted air having contaminants therein passes through an electrostatic precipitator located in a filter enclosure where the oil particles are separated from the air. The air is exhausted from the precipitator through the blower into the atmosphere, whereas the oil, following separation, drops to the bottom of the precipitator where it passes through a filter and is recirculated to the spraying chamber.

The spraying system of the present invention serves to provide a protective coating of lubricating oil or fluid on a conveyor chain or the like in which any overspray is recaptured and recirculated to the spraying chamber. The fluid is substantially evenly sprayed onto the conveyor. A baffle system serves to separate the enclosure assembly into a spraying chamber and two evacuating chambers located adjacent the spraying chamber. Substantially all the fluid which is in excess of the fluid deposited on a conveyor chain or part is recaptured and recirculated for further use. The device serves to coat a chain while keeping the environment surrounding the spray coating device free of any contaminants. The device disclosed in the present invention is relatively compact and can accomodate different styles of conveyor systems.

BRIEF DESCRIPTION OF THE DRAWINGS

The invention will be better understood from the following detailed description thereof, taken in conjunction with the accompanying drawings wherein.

DETAILED DESCRIPTION OF THE DRAWINGS

Figure 1:
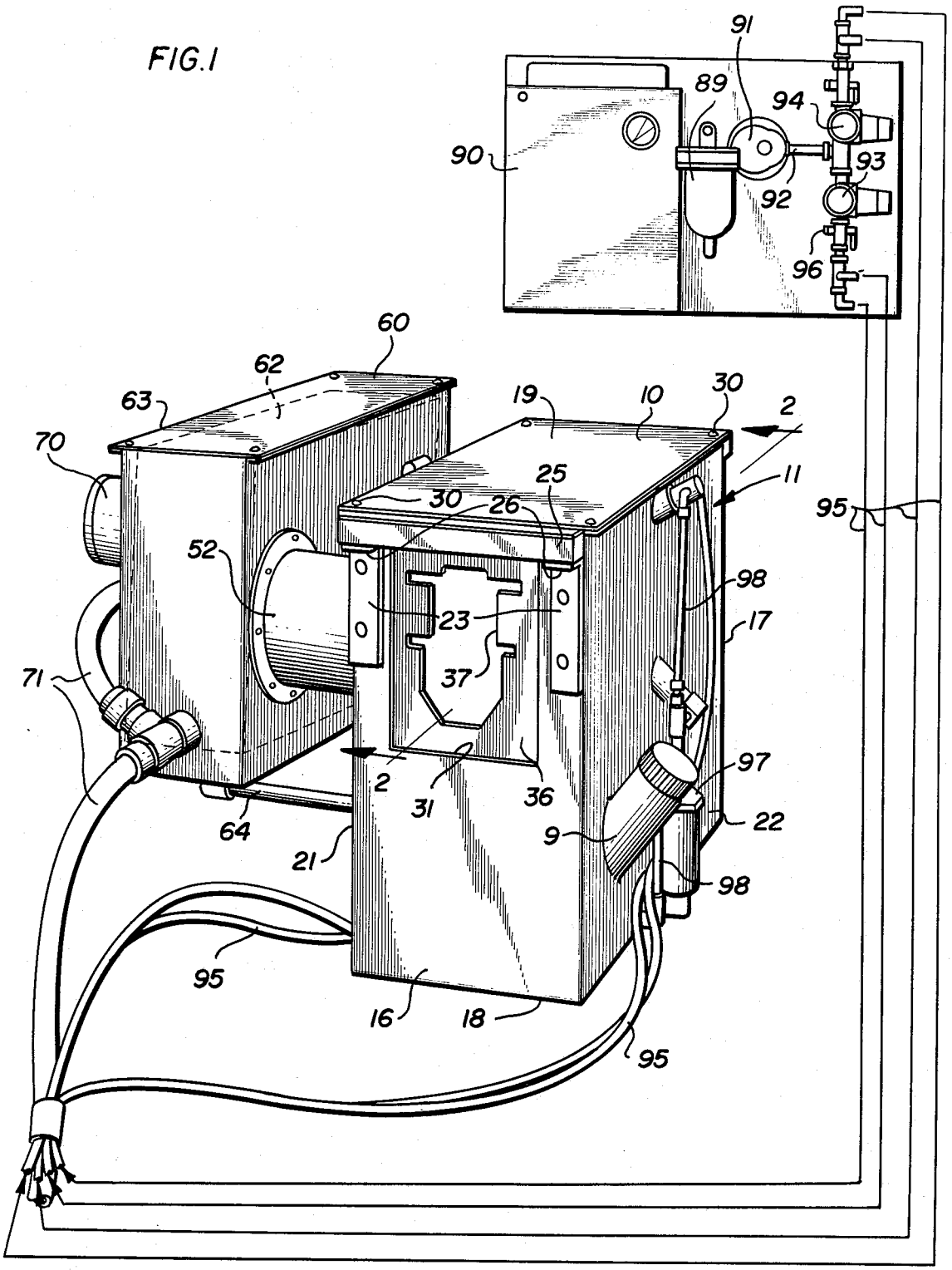
FIG. 1 shows a perspective view of the spray coating device of the present invention.

Referring to the drawings, spray coating device 10 comprises an enclosure assembly 11 and filter station 60 and an exhaust blower 70.

Enclosure 11 includes compartments 12, 13, 14 through which conveyor 15 travels. Enclosure 11 comprises end walls 16, 17, bottom wall 18, top wall 19 and side walls 21, 22. The walls of the enclosure can be individual pieces which are fastened together to make a leak-proof connection, or the enclosure assembly can be an integral structure such as illustrated in the drawings where the bottom, side and end walls form one piece.

Top wall 19 is a plate which fits over the top of the enclosure and is adapted to be bolted to the flanges of side walls 21, 22 by means of screws 30.

A pair of brackets 23, are fastened to end wall 16 while another pair of brackets 24, are fastened to end wall 17. Bar 25 is seated on bracket arms 26 while bar 27 is seated on bracket arms 28. The bars, which serve as stiffener and mounting members for enclosure 11, are secured to the arms by means of bolts 29.

Figure 2:
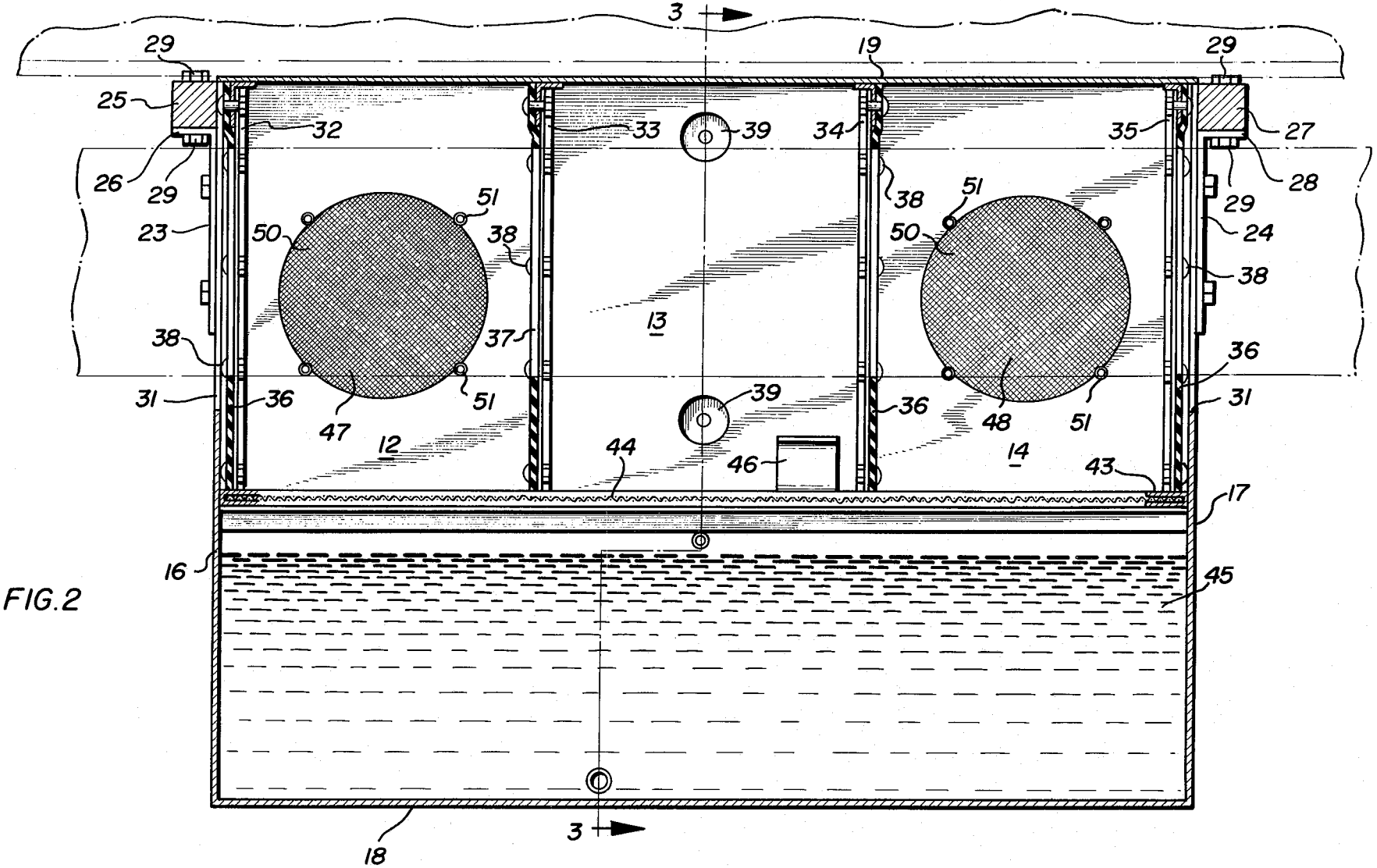
FIG. 2 shows a section view of the spraying and displacement chambers taken along lines 2—2 in FIG. 1; and, FIG. 3 shows a section view of the spray coating device of the present invention taken along lines 3—3 in FIG. 2.

Each of the end walls has an opening 31, as shown in FIGS. 1 and 2. Openings 31 are large enough to accommodate different size conveyors chains.

Figure 3:
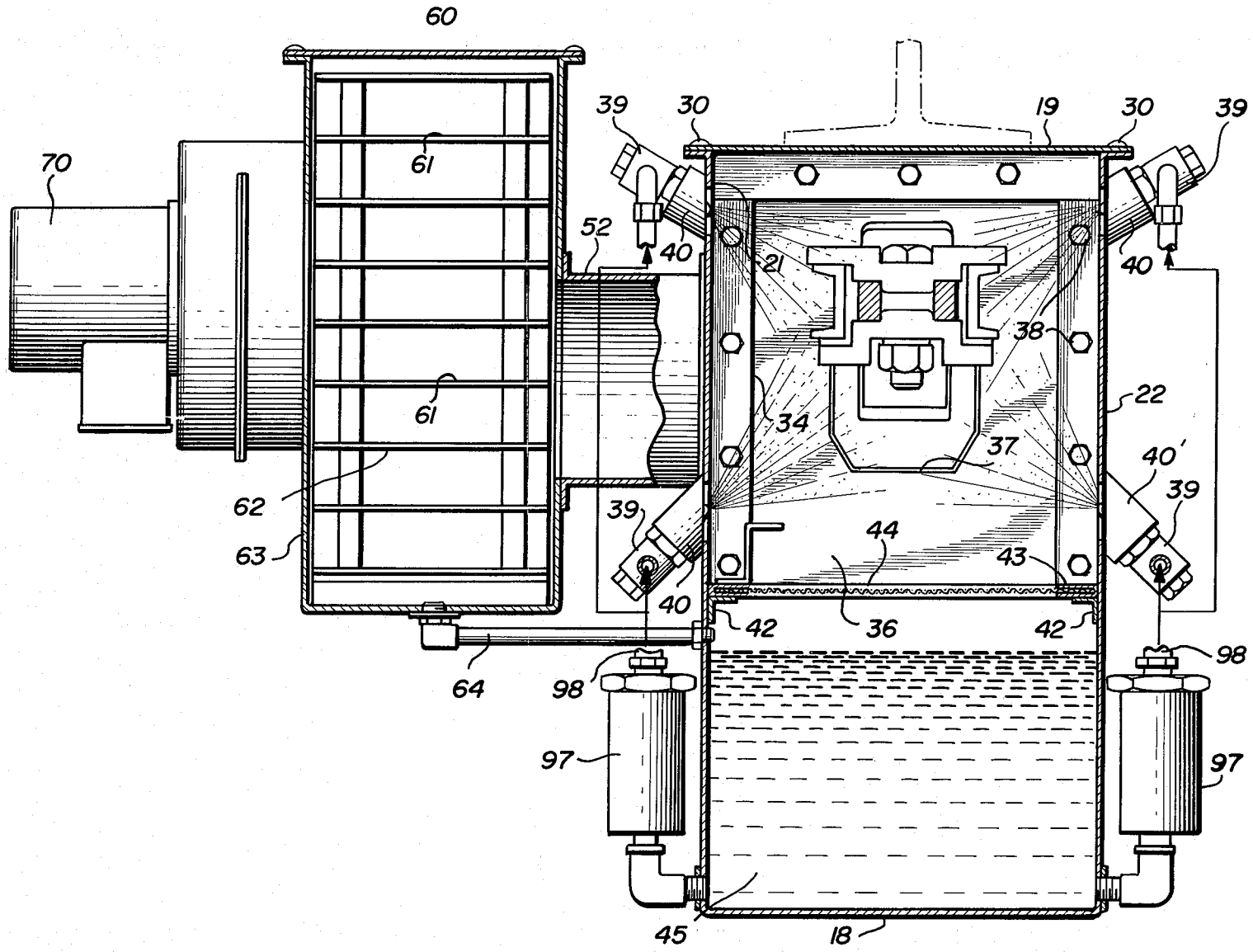

As illustrated more clearly in FIGS. 2 and 3, a plurality of spaced, U-shaped brackets 32, 33, 34 and 35 depend from top plate or wall 19. Each bracket base can be welded or attached by other suitable means to the inner wall of the top plate. A flexible baffle member 36 is attached to each of the brackets. The baffle member, which can be made of rubber or other suitable material, has a configuration 37 which substantially conforms to the outer periphery of the conveyor to be coated. The baffle members are attached by suitable means such as bolts 38 to the legs and base of the metal U-shaped bracket members.

When the top plate and its attached baffle members are positioned relative to the rest of the enclosure assembly 11, three chambers or compartments 12, 13 and 14 are formed. The openings 37 in baffle members 36 are alined with each other and are positioned relative openings 31 in end walls 16, 17 so that a conveyor can pass through enclosure 11 without contacting enclosure end plates 16, 17.

A pair of angles 41, 42 are attached to the inner walls of side walls 21, 22. Plate 43, having filter screen 44, is adapted to sit on the angles. A hand grip 46 is attached to filter plate 43 and allows an operator to remove plate 43 from enclosure assembly 11 merely by grasping the hand grip. The space below plate 43 serves as a fluid reservoir 45.

The heads of four air-atomizing spray nozzles 39 project into spray chamber 13. Each spray nozzle serves to spray fluid into chamber 13, whereby a conveyor passing through the chamber will be coated with fluid. Two spray nozzles 39 are removably mounted in brackets 40 located in side wall 21 and two more nozzles 39 are removably mounted in brackets 40 attached to side wall 22. Spray nozzles 39, as seen in FIG. 3, are positioned at an angle relative to a conveyor to be coated so that the fluid will be evenly sprayed onto a chain as it passes through the enclosure. One example of a spray nozzle assembly which can be utilized is available from Spraying Systems Corporation, Wheaton, Ill., and is disclosed in a brochure entitled "Spray Nozzles and Accessories", Cat. # 26, p. 46. The fluid is dispensed into chamber 13 so that the fluid mixed with atomizing air is turbulent in form.

The spray nozzles employ compressed air to provide suction for siphoning fluid delivered from reservoir 45 to the mixing chamber in nozzle 39 from where the fluid is sprayed onto a chain traveling through chamber 13. The quantity of fluid dispensed can be changed by adjusting the air pressure to the nozzles. The spray pattern can be changed by changing the fluid head on the air atomizing nozzle.

Exhaust chambers 12 and 14 located on either side of fog chamber 13 exhaust openings 47, 48 located in side wall 21. Each opening has a screen filter 50 covering it, the filter being held in place by suitable retaining bolts 51. The openings 47, 48 lead to an air duct 52 which, as seen in FIGS. 1 and 2, is a tubular member which surrounds openings 47, 48. If desired a separate air duct 52 could be used with each of the openings 47, 48. Duct 52 is connected to one side of filter station 60. An exhaust blower 70 is positioned on the opposite side of the filter station.

Filter station 60 comprises an electrostatic precipitator 62 which is disposed in an enclosure 63. The precipitator serves to remove particles of fluid from the air. The electrostatic precipitator used to filter the air and the power pack for operating the precipitator are available commercially. One source is Hastings Distributor Company, Milwaukee, Wis. The precipitator which is disposed within enclosure 63 and the power pack are disclosed in Hastings Owner Manual No. 1964, under Operational Model 500, part nos. 10521-100-300.

As contaminated air passes through the filter, the fluid particles are given an electrical charge, whereby the particles will be attracted to plates 61 which are of opposite charge. Precipitator 62 in which are plates 61 in which are mounted at an angle so that fluid attracted to the plates will run down the edge of the plates where the fluid drops to a reservoir at the bottom of the filter assembly. Fluid in the reservoir of filter enclosure 63 passes by conduit means 64 to enclosure assembly 11 where the fluid is deposited in reservoir 45.

After the air has been filtered of fluid particles, it exits from the system through exhaust blower 70 to the atmosphere. A blower which has been found satisfactory for this application is referred to as a Shaded Pole Blower, Model 4 C 442, available from W.W, Grainger, Inc., Madison, Wis. The blower specifications are further described in Grainger's motorbook #342, p. 552.

In operation, a conveyor chain to be coated preferably will be located at a straight and level portion of a conveyor track. Depending upon the application, a portion of the conveyor track is removed and the enclosure 11 of lubricating device 10 is positioned so that the conveyor chain will pass through the openings 37 in baffle members 36. While the baffle members are shown as solid members having an opening in them, it is appreciated the flexible members may be slit in order to position the members relative to the chain to be lubricated.

Fluids such as oil are placed in reservoir 45 through filler tube 9.

Upon actuation of the device, electric power will be supplied from a conventional source to the filter 60 and blower 70, as illustrated at 71.

Compressed air normally supplied from a conventional air supply passes through air filter 89 adjacent control panel 90. The air then passes through solenoid valve 91 and conduit 92 to air regulating valves 93, 94, which serve to adjust the amount of air which passes to nozzle units 39 through hoses 95.

As air passes through nozzles 39, fluid is siphoned to the nozzles from reservoir 45 via filters 97 and conduit 98. The fluid is then sprayed in chamber 13 and coats the chain or other parts as they pass through compartment 13 in the direction of the arrow in FIG. 2.

The contaminated or fluid entrained air from chamber 13 will pass to chamber 12, where it is evacuated through opening 47 to duct 52. The contaminated air has the fluid particles removed at filter 60. The removed particles drop to the bottom of the filter enclosure 63 and pass by conduit means 64 to reservoir 45 where the fluid is recirculated to coat the conveyor chain. The air, after it has been decontaminated, is exhausted from the system through blower 70.

When exhaust blower 70 is operating, the air flow through filter station 60 is greater than the air flow being continually displaced from chamber 13. Accordingly, air from outside of assembly 11 is drawn into exhaust chambers 12 and 14 through the openings in baffle members 36 which separate those chambers from outside of the enclosure assembly 11. With air drawn into the chambers 12, 14 from outside enclosure 11, contaminated air, i.e., oil entrained air, also passes through openings 47, 48, duct 52 and filter 60. Thus, all the air entering chambers 12, 14 flows through filter 60.

It has been found that relatively large or fast moving conveyors tend to develop a wind tunnel effect inside the enclosure 11 such that it is not necessary to exhaust air from the exhaust chamber on the side of the fog chamber 13, which the conveyor chain enters first; however, it is desirable to have a greater exhaust air flow from the exhaust chamber on the side of the fog chamber which the conveyor chain enters last. This increase in air flow can be accomplished by reducing or sealing off opening 48 from the exhaust duct 52, thereby increasing the air flow in the exhaust chamber in which the increased air flow is required.

All the contaminated air from chamber 13 flows to one of the exhaust chambers. If the conveyor chain enters enclosure assembly 11 by initially passing through chamber 14, the contaminated air in chamber 13 will be exhausted through chamber 12. From chamber 12 the air is drawn through filter station 60 by exhaust blower 70 which is of a size sufficient to exhaust the contaminated air.

Blower 70 should be of sufficient size to exhaust the contaminated air but should not be oversized, for too rapid air flow across filter 60 reduces the effectiveness of filter 60.

The only fluid which would appear to be lost from the conveyor spray coater device of the present invention is that which is deposited on the conveyor chain. The unused fluid is returned to reservoir 45. Any fluid which collects on the inside of enclosure assembly 11 flows by gravity downward to reservoir 45. Any large particles which might fall from the conveyor will be caught by filter screen 44, thus preventing these particles from dropping into the reservoir and eventually plugging the filters 97 which filter the fluid which passes from the reservoir 45 to nozzle units 39. Screen 44 can be removed and cleaned of any particles and replaced to sit on angles 41, 42.

While controls for actuating the cycling of the spray coating system and the time of operation have not been illustrated, it is appreciated it would be obvious to one skilled in the art to utilize conventional components for controlling the actuation of the spray coating system.

The baffle members can be made of a flexible material. For example, the members could be made of neoprene, while the enclosure could be made of a metal material.

The spray coating device of the present invention provides the spraying of a fluid in an enclosure through which a conveyor chain and attachments pass in which substantially all of the spray is recaptured, thereby preventing contamination of the environment outside enclosures assembly 11. The device is a compact unit and can be readily installed.

The foregoing detailed description has been given for clearness of understanding only and no unnecessary limitations should be understood therefrom, as modifications will be obvious to those skilled in the art.

What is claimed is:

1. A spray coating device for coating parts of a conveyor with a fluid, said device comprising:

an enclosure assembly having entrance and exit openings through which said parts to be coated are adapted to pass;

said assembly having a reservoir for holding said fluid, said assembly including a baffle means for separating said assembly into at least one fluid spray chamber and at least one evacuating chamber;

said fluid chamber including means coupled to said assembly reservoir for spraying said fluid mixed with air onto said conveyor parts;

blower means coupled to said assembly for drawing air into said assembly through said openings to prevent said fluid mixed with air from passing from said enclosure assembly through said openings and for exhausting said air, filter means including an electrostatic precipitator coupled in series with said blower means and said evacuating chamber for removing excess fluid remaining in said air before said air is exhausted by said blower means;

said filter means including a reservoir for collecting excess fluid removed from said air by said electrostatic precipitator; and means including a conduit connecting said filter reservoir and said assembly reservoir for draining said excess fluid accumulated in said filter reservoir to said assembly reservoir.

2. A spray coating device in accordance with claim 1 wherein said enclosure assembly further includes:

a structure having a bottom wall, two end walls and two side walls and a top wall;

said end walls each having an opening therein, said top walls being adapted to be removably secured to said enclosure;

said top wall having a plurality of flexible baffle members attached to the inner wall of said top wall;

said baffle members serving, when said top wall is positioned on said enclosure, to separate said enclosure into at least three chambers which include said fluid spraying chamber and at least one said evacuating chamber located on each side of said spray chamber; and, each baffle member having openings therein of a configuration substantially the same as the outer shape of a conveyor to be lubricated.

3. A spray coating device in accordance with claim 2 wherein said enclosure further includes a filtering means positioned below the location where a conveyor is adapted to pass through said chambers, whereby fluid can pass through said filter means in said enclosure assembly to the bottom of said structure which serves as said assembly reservoir for said fluid.

4. A spray coating device in accordance with claim 2 and further including means for siphoning fluid from said reservoir in said enclosure assembly to said spray means.

5. A spray coating device in accordance with claim 4 wherein said spraying means includes at least one fluid spray nozzle positioned in one of said walls of said enclosure assembly at the location of said fluid lubricating chamber.

6. A spray coating device in accordance with claim 2 including duct means connecting each of said evacuating chambers to said filter means for passing said excess fluid and air from said assembly to said filter means.

7. A spray coating device in accordance with claim 1 wherein said electrostatic precipitator has plurality of charged plates for attracting said fluid which is oppositely charged and including means for mounting said electrostatic precipitator such that said plates are at an angle, said fluid attracted to said plates running down said plates and dropping into said filter reservoir.

* * * * *